US010659907B2

(12) United States Patent
Sherburne et al.

(10) Patent No.: US 10,659,907 B2
(45) Date of Patent: May 19, 2020

(54) SYSTEM FOR DISTRACTION AVOIDANCE VIA SOUNDSCAPING AND HEADSET COORDINATION

(71) Applicant: Plantronics, Inc., Santa Cruz, CA (US)

(72) Inventors: Philip Sherburne, Morgan Hill, CA (US); Beau Wilder, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 15/890,232

(22) Filed: Feb. 6, 2018

(65) Prior Publication Data

US 2019/0246234 A1 Aug. 8, 2019

(51) Int. Cl.

| | |
|---|---|
| ***H04S 7/00*** | (2006.01) |
| ***H04R 5/033*** | (2006.01) |
| ***H04R 5/04*** | (2006.01) |

(52) U.S. Cl.

CPC ..... *H04S 7/304* (2013.01); *H04R 5/033* (2013.01); *H04R 5/04* (2013.01); *H04S 7/308* (2013.01)

(58) Field of Classification Search

None

See application file for complete search history.

(56) References Cited

U.S. PATENT DOCUMENTS 5,822,440 A 10/1998 Oltman et al.
8,340,309 B2 12/2012 Burnett et al.
9,129,291 B2 * 9/2015 Goldstein ..... G06F 21/10
9,332,372 B2 5/2016 Meyer
2007/0121959 A1 * 5/2007 Philipp ..... H04R 1/1041 381/74
2014/0079243 A1 * 3/2014 Appell ..... H03G 3/32 381/86
2014/0254830 A1 * 9/2014 Tomono ..... H04R 1/1041 381/107
2014/0334644 A1 * 11/2014 Selig ..... H03G 5/165 381/108
2015/0190284 A1 * 7/2015 Censo ..... G10K 11/175 128/867
2015/0281830 A1 10/2015 Gauger, Jr. et al.
2015/0348530 A1 12/2015 Findlay et al.
2017/0147281 A1 * 5/2017 Klimanis ..... G06F 3/165
2018/0103080 A1 * 4/2018 Girish ..... H04M 1/72533
2019/0037298 A1 * 1/2019 Reily ..... H04R 1/1041
2019/0042647 A1 * 2/2019 Oh ..... G06F 16/637
2019/0200080 A1 * 6/2019 Alsina ..... H04N 21/25891

OTHER PUBLICATIONS

Unknown, "Habitat Soundscaping Human+Nature—Making Open Offices Work," Brochure, Oct. 4, 2017, 4 pages, found at URL <https://habitat.plantronics.com/wp-content/uploads/2017/10/Habitat-Soundscaping-Brochure.pdf>.

* cited by examiner

*Primary Examiner* — Paul W Huber

(74) *Attorney, Agent, or Firm* — Haynes Beffel & Wolfeld LLP

(57) ABSTRACT

A system can include a headset and a host device for use in a soundscape environment in which audio tracks are played. Logic in communication with an audio driver on the headset causes an audio sample to be played, and coordinated with the soundscape audio track being played in the soundscape environment. Memory can store one or more audio samples having audio content coordinated with corresponding one or more audio tracks of the soundscape environment. A Don/Doff sensor generates a Don signal indicating that an individual has put on the headset.

21 Claims, 6 Drawing Sheets

SYSTEM FOR DISTRACTION AVOIDANCE VIA SOUNDSCAPING AND HEADSET COORDINATION

BACKGROUND

Field

The present invention relates to audio headsets, and circuitry for controlling operation of audio headsets in coordination with soundscaping.

Description of Related Art

Open office environments are used in many businesses, where they can promote collaboration among workers while making efficient utilization of office space. A problem associated with open office environments relates to distraction that can be caused by activity of coworkers in the space.

Technologies have been developed to reduce distraction, by for example projecting sounds, such as so-called white or pink noise, into the environment that mask distracting sounds. However, noise masking techniques can become uncomfortable to workers in the space over time as they become aware of, or effected by, the masking sounds.

Also, these technologies are designed to insulate users from distracting, intelligible speech that are outside a zone of intelligibility for persons in the space. Sometimes however, speech that is not intended for a particular person can occur within the zone of intelligibility around the particular person, and cause significant distraction.

For these kinds of distractions, a person may elect to use a headset and turn on noise suppression or play streaming music. The music can be mostly pleasant, but may itself be distracting. Also, where the headset is also used in coordination with a telephone, a user can find it distracting or difficult to transition between music and telephone calls, and back to music. Noise suppression can also be uncomfortable over time.

It has been proposed as well that headsets could be used to play white or pink noise to reduce distractions from the environment. White or pink noise however has been found fatiguing to listen to for any length of time, and is therefore not a satisfactory solution.

It is desirable therefore to provide technologies to improve the use of headsets in coordination with technologies that mask distractions in open office environments.

SUMMARY

A system is described including a headset, a host device and a soundscape system. The system includes logic to cause the headset to play an audio sequence in coordination with an audio track of a soundscape environment. The audio tracks can be biophilic and played in coordination with visual elements and water features to provide a pleasing and energizing environment.

In one aspect, a headset is described including a speaker and an audio driver coupled to the speaker. Logic in communication with the audio driver is provided on the headset or on a host device, to indicate an audio sequence for the headset based on metadata related to a soundscape environment, and to cause the indicated audio sequence to be played using the speaker on the headset, The logic can identify a track currently being played in a soundscape environment, and said metadata related to the soundscape environment can identify the track currently being played. A switch can be included responsive to a sensor on the headset, which generates a Don signal when the headset is placed on a user's head or when a button is pushed. The logic can be responsive to the Don signal to initiate playing of the audio sequence.

In some embodiments, the logic can be location aware, including logic to determine location of the headset, and to use the location to identify the soundscape environment.

In some embodiments, the logic can be actively in communication with the soundscape environment, including logic to communicate with a server which controls the audio tracks played in the soundscape environment, and to change the audio sequence in response to a change indicated by the communications with the server.

In various implementations, the logic can be distributed between the headset and a host device, including for example wherein the headset includes logic to communicate with a host device in communication with a server, the server controlling the audio tracks played in the soundscape environment, and can change the audio sequence in response to a change in the audio tracks played in the soundscape environment indicated by communications from the host device.

Memory can be included, storing one or more audio samples having audio content coordinated with one or more corresponding audio tracks of soundscape environment on the headset. The logic to indicate an audio sequence can select an audio sample from the one or more audio samples in the memory for the audio sequence, enabling the playing of the audio sequence without requiring maintenance of an audio data channel between the host and the headset carrying the data for the audio sequence.

In one variation, the headset includes logic to communicate with a host device, and the host device includes said logic to indicate an audio sequence, and the headset includes said memory.

In another variation, the headset includes logic to communicate with a host device, and to play audio signals, such a live streaming of music, received from the host device, and including logic to cause the playing of the indicated audio sequence to pause and resume in response to messages from the host device.

Also, the headset can include logic to communicate with a host device including a telephone, and to play audio signals received from the host device, and including logic to cause the playing of the indicated audio sequence to pause and resume in response to messages from the host device related to an active call on the telephone.

To avoid uncomfortable transitions of sounds in the soundscape environment, the logic can respond to the Don signal to cause volume of the audio sequence to transition from an initial volume to a target volume.

Other aspects and advantages of the present technology can be seen on review of the drawings, the detailed description and the claims, which follow.

DETAILED DESCRIPTION

A detailed description of embodiments of the present invention is provided with reference to the FIGS. 1-6.

Figure 1:
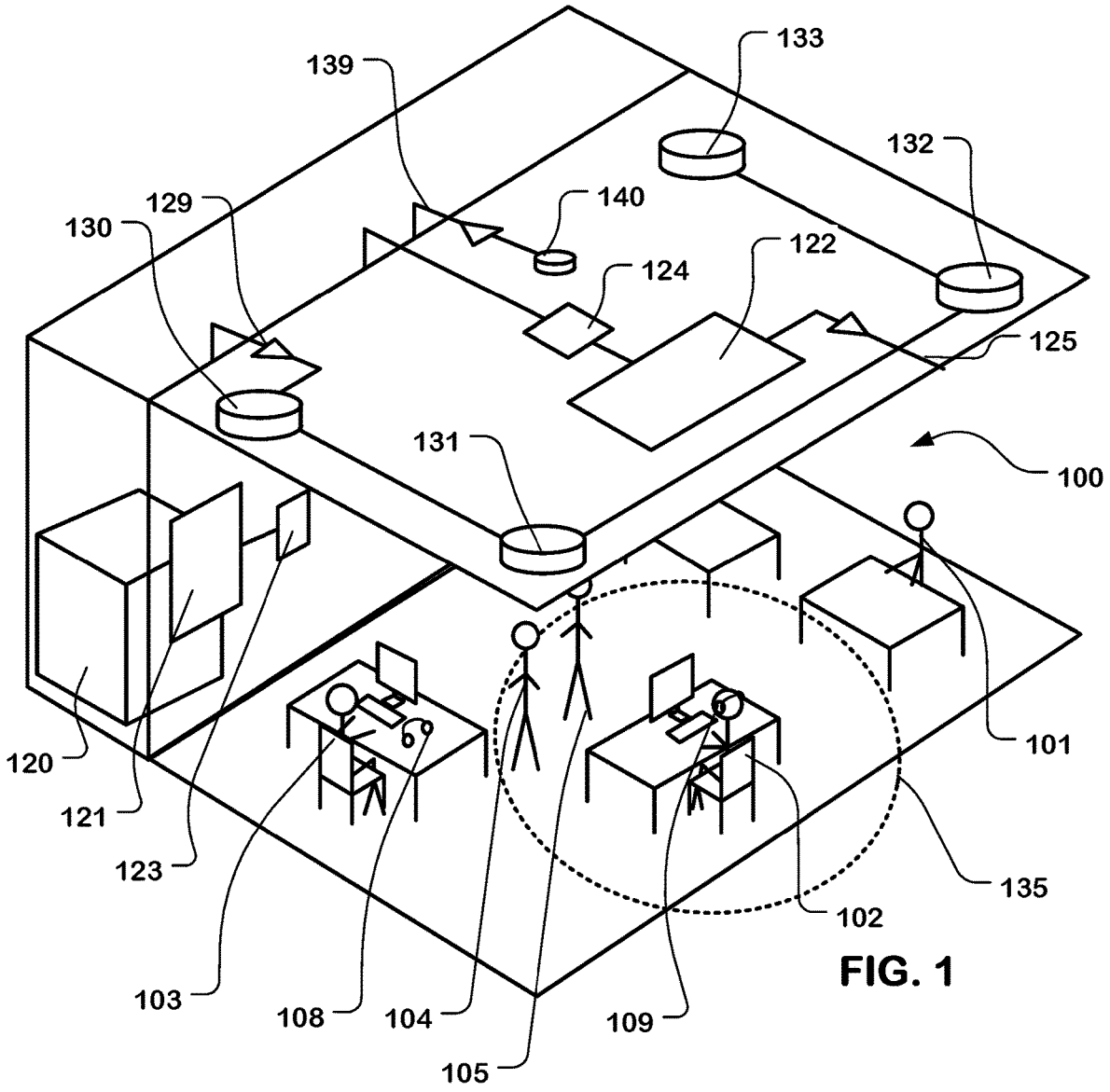
FIG. 1 is a simplified diagram of a soundscape system supporting coordinated headsets as described herein.

FIG. 1 illustrates an example of a soundscape system deployed in an open office environment. The open office environment includes workspace 100 in which a number of individuals 101, 102, 103, 104, 105 are present. In the illustration, a headset 108 is seen on a desk at which individual 103 is sitting. Also, a headset 109 is on the head of the individual 102.

The soundscape system includes a computer system 120 which can execute soundscape server programs in this example which manage operation of the components of the soundscape system. In other examples, computer system 120 may coordinate with cloud-based soundscape server programs accessed for example via the Internet.

The system includes a display 121 which plays video content provided by a video player 123, which is in turn coupled to the computer system 120. The display 121 can be characterized as a digital window.

The system includes display 122 which plays video content provided by a video player 124, which is in turn coupled to the computer system 120. The display 122 can be characterized as a digital skylight. There may be a plurality of digital skylights coupled via an amplifier on line 125 to the video player 124.

A plurality of speakers 130, 131, 132, 133 is arrayed around the workspace 100, in the ceiling in this example. An audio driver 129 drives the soundscape tracks provided by the soundscape server via the computer system 120.

In this example, a distraction sensor 140 is coupled via an amplifier on line 139 to the computer system 120, the output of which can be utilized by the soundscape server programs to adjust and change the soundscape audio track and video content being executed at any particular time.

A soundscape as illustrated in FIG. 1 can transform an open office into an intelligent, multi-sensory experience that facilitates teamwork and enables workers to maintain focus. Natural sounds can be used that dynamically adjust to changing noise levels and integrate with complementary visible elements that satisfy an innate human desire to feel close to nature while relieving stress and rejuvenating the senses.

The audio tracks being played can change from time to time within a soundscape. Also, different audio tracks can be played in different open office environments.

As illustrated in FIG. 1, a zone of intelligibility 135 surrounds each of the individuals in the open office environment workspace 100. If, for example, the individuals 104 and 105 are having a conversation, then that conversation could distract the individual 102 and the soundscape server programs may not be able to compensate.

As described herein, the individual 102 can put on (Don) a headset 109 which plays an audio sample coordinated with the audio track being played in the soundscape to reduce the distraction. A headset however, can isolate the individual becomes from the audio aspects of the soundscape provided through the plurality of speakers. As described herein, the headset is configured to coordinate with the soundscape so that the transition to wearing the headset is subtle, with the goal of maintaining the soundscape experience while the headset is being worn, without creating a jarring experience that causes distraction.

Figure 2:
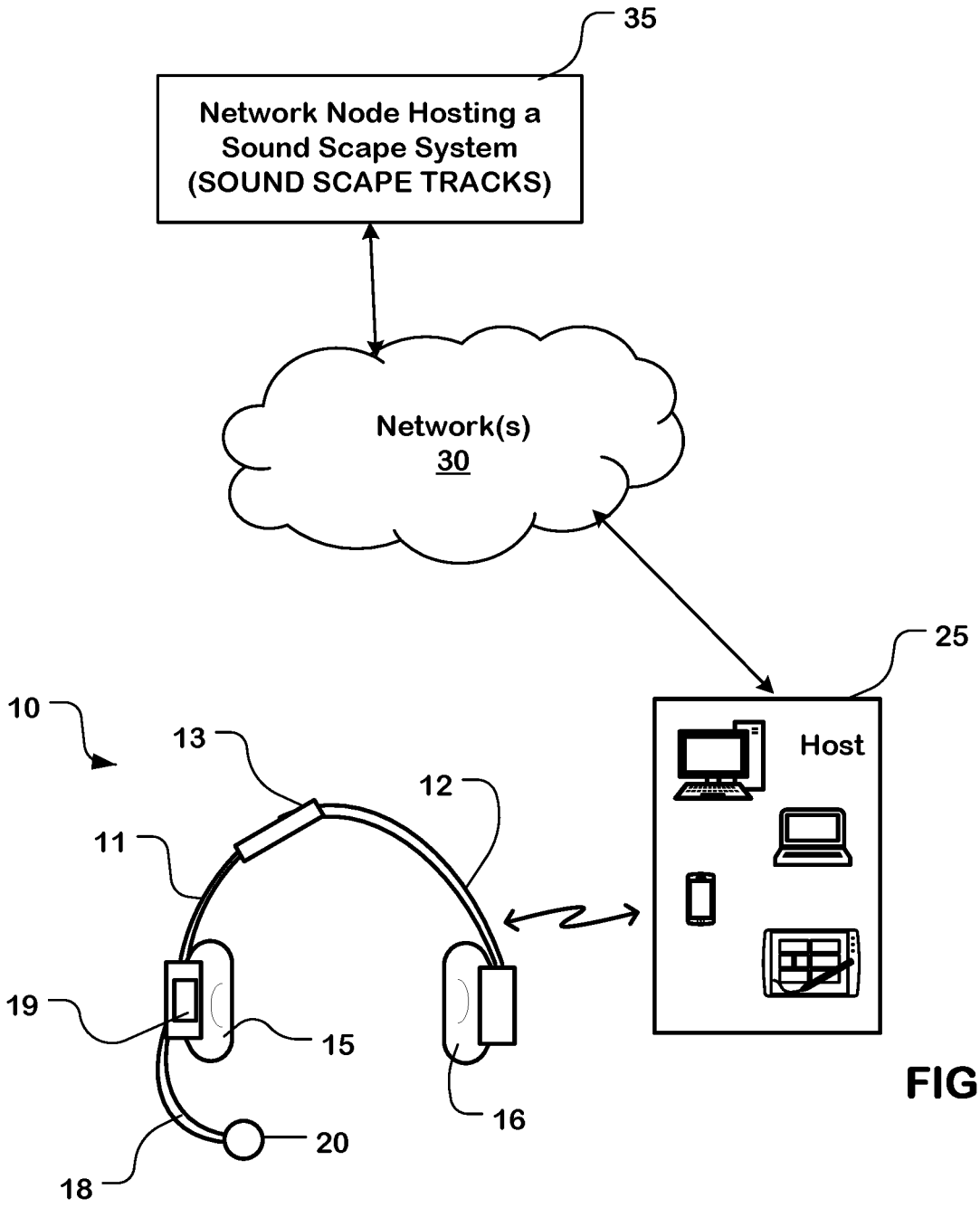
FIG. 2 illustrates a network environment including a headset configured for coordination with a soundscape system.

FIG. 2 is a simplified diagram of a network environment including a headset 10 of the type that is configured to communicate, either wirelessly or by a corded connection (not shown), with a host device 25, such as a smartphone, a personal computer, a laptop computer, a tablet computer or other sources of audio streams to be played by the speakers on the headset 10. The host device 25 in turn is configured to communicate via network 30 such as the Internet or a local in-house network, with a network node 35 hosting a soundscape server, which can be a public network, or "cloud", based system or a system on a private network. The soundscape server will operate to control the components of a soundscape implemented in an open office environment, including selecting and playing an audio track.

As used herein, a network node is an active electronic device or virtual device that is attached to a network, and is capable of sending, receiving, or forwarding information over a communications channel. Examples of electronic devices which can be deployed as hardware network nodes include all varieties of computers, workstations, laptop computers, handheld computers, and smartphones. Network nodes can be implemented in a cloud-based server system. More than one virtual device configured as a network node can be implemented using a single physical device.

A host device 25 is typically a computer system, comprising a processor and memory storing computer programs that are executable using the processor. Also, host device 25 can include communication ports for wireless or corded connection to the headset 10, along with protocol stack software for maintenance and establishment of communication channels with the headset and with network nodes in the network 30. In some examples, the host device 25 includes a telephone and logic for communication with the headset and coordination of telephone calls, such as answering an incoming call, transmitting audio received during the call to the headset, delivering audio from the headset in support of the call, call hang up signaling, call auto answer signaling and so on. Also, in some examples, the host device is utilized to provide streaming audio, such as music or audio tracks from videos being played by the host device, to the headset. Communication with a host device and the headset can include play/pause/resume operations for these types of audio tracks. In some examples, the host device 25 can be implemented by circuitry and computer programs disposed on the headset. Also, some of the functions of the host device 25 discussed herein coordinate with logic on the headset. Elements of these functions can be distributed between the headset and the host device as suits a particular implementation, and any suggestion that any particular element of logic or function is located on the host device or on the headset is not intended, unless explicitly stated herein.

The headset 10 in this example includes a headband which is composed in this example of a first strip 11 and a second strip 12 coupled by a guide 13 allowing adjustment of the length of the headband. The headset 10 includes ear cups 15 and 16, referred to herein more generically as speaker capsules. In FIG. 2, a microphone boom 18 is coupled to the ear cup 15, and includes a microphone 20 at the distal tip. The microphone boom 18 may not be utilized in other embodiments. In some headsets, there is only one speaker capsule. Also, some headsets are ear-mounted, and may lack a headband.

Electronic components 19 are mounted on the headset, and include a power source such as a battery, a communication interface, a logic circuitry such as a data processor which can execute computer programs, an audio driver for the speakers, and other components. In this example, the electronic components 19 include a Don/Doff sensor like that described below with reference to FIG. 3.

Don/Doff sensing can be used to operate a switch used to control operations by the electronic components 19 on the headset, including one or more of audio processing and amplification functions like noise cancellation, active filtering and equalization. Also, Don/Doff sensing can be used to control operations for maintenance and establishment of communication channels with the host device for signaling functions like pause/play/resume, auto-answer an incoming call, hang up a call and other user experience enhancement operations. Also, Don/Doff sensing can be used to control operations enabling logical and/or physical layer operation of corded (e.g. USB) and wireless (e.g. Bluetooth) interface circuits, and other functions useful for power management and enhancement of user experience. In one example, when the headset senses a Doff state, the electronic components execute an operation to enter a power saving mode, in which the power consumed by the electronics on the headset is reduced compared to an operating mode in effect at the time the signal was received. In one example, when the headset is in a Don state, electronic components execute an operation to monitor communication channels for active audio streams, to manage a communication protocol with a host device and to receive and drive audio signals in the speakers.

Also as described herein, Don/Doff sensing can be used to support coordination of audio samples played using the headset with an audio track being played in a soundscape system. In alternative embodiments, push button on the headset, or a user interface on the host device can be used place of, or in coordination with, Don/Doff sensing enable and disable logic to cause audio sequences to be played in coordination with audio tracks played in a soundscape. Also, push button on the headset, or a user interface on the host device, can be used to toggle a soundscape sequence on and off.

Either the headset or the host device can include logic to identify a location of the headset, and to communicate the location to a server or other resource to identify a soundscape system in control of the identified location. The metadata for the headset can be simply the location data, or can be provided from the server or host based on the soundscape in control of the identified location. Location identification logic can include a user interface on the host device, by which a user inputs a location. Also, location identification logic can include sensors such as GPS sensors or beacon proximity sensors. In some embodiments, the location identification can in include a combination of logic elements on the headset and the host. In yet another embodiment, a soundscape server may identify a location of a headset using network communications data, such a network addresses and routing information carried in communications with the headset and host.

In general, an apparatus is described for use in the soundscape environment in which audio tracks are played. The apparatus can comprises a headset including a speaker and an audio driver coupled to the speaker. In one approach to providing audio sequences for coordination with soundscapes, memory in the apparatus can stores one or more audio samples having audio content coordinated with one or more corresponding audio tracks of the soundscape environment. A sensor on the headset can generate a Don signal when the headset is placed on a user's head. Logic in communication with the audio driver is included, to cause an audio sample of the one or more audio samples stored in the memory to be played using the speaker on the headset in response to the Don signal, and coordinated with the audio track being played in the soundscape environment. The audio sample can be played in a loop, so that it can remain a relatively small amount of data suitable for storage in memory on a headset and for communication to the headset with limited resources. The logic can include a first mode is initiated in response to the Don signal in which the volume of the audio sample transitions from an initial volume to a volume coordinated with an audio track being played in the soundscape environment, and can include a second mode in which the volume of the audio sample remains coordinated with the audio track being played in the soundscape environment.

In embodiments described in which the apparatus includes logic to store metadata related to soundscape environment in the memory, such as a soundscape identifier or an identifier of a current audio track in a soundscape. The logic can indicate an audio sequence in response to the metadata. Logic, such as executed by a host device can communicate with a source of the audio tracks played in the soundscape environment to retrieve metadata concerning the soundscape environment. The apparatus can change the audio sample being played in response to a change indicated by the metadata.

In an embodiment described, the headset includes logic to communicate with a host device, and the host device includes logic in communication with the audio driver to cause an audio sample of the one or more audio samples stored in the memory to be played, and wherein the headset includes the memory.

Also in embodiments described, messages or other communications from the host device can be processed to cause the playing of the audio sample to pause and resume. Also, in embodiments described, the host device can include a telephone, and the logic causing playing of the audio samples in coordination with soundscape environment can cause the playing of the audio sample to pause and resume in response to messages from the host device related to an active call on the telephone. In general, the playing of the soundscape audio sequence can be controlled by priority logic on the headset, which selects a source of audio data to be played at the headset based on a selected priority schedule. For example, a phone call may have highest priority. A music stream selected by the user may have second priority. The soundscape audio sequence may have third priority.

Also, embodiments are described in which the headset can be "location aware", where the audio sample selected to be played in coordination with the soundscape is determined in response to metadata indicating that the headset is present within a particular soundscape environment.

In some embodiments, the host device can include a user interface by which the soundscape coordination functions of the headset can be turned on and turned off. Also, the user interface can be used to enter metadata, such as metadata related to the soundscape environment in which the headset is located.

Also, methods for operating a headset are described. A method for operating a headset as described herein can include obtaining an audio sequence to play in coordination with a soundscape, such as by storing one or more audio samples having audio content coordinated with one or more corresponding audio tracks of a soundscape environment, generating a Don signal when the headset is placed on the user's head, and causing the audio sequence to be played using a speaker on the headset coordinated with the audio track being played in the soundscape environment.

The method can include operating a headset in a first mode in response to the Don signal in which the volume of the audio sample transitions from an initial volume to a target volume, where the target volume can be selected or coordinated with the audio track being played in the soundscape environment, and in a second mode in which the volume of the audio sample is maintained at the target level.

The method can include storing metadata related to the soundscape environment in memory on the headset or in the associated host device. The audio sample played in coordination with the soundscape environment can be selected in response to the metadata.

In embodiments of the method, the metadata can be retrieved from a server which controls the elements of the soundscape environment. For example, the method can include changing the audio sample in response to a change indicated by the metadata in the audio track played in the soundscape environment. Also, the method can include causing an audio sample of the stored one or more audio samples on the headset to be played in response to control signal from the host device indicating a soundscape coordination mode.

In other aspects, the method can include causing the audio sample being played in coordination with the soundscape to pause and resume in response to messages from the host device indicating an active call on a telephone, or in response to other types messages generated on the host device. Priority can be applied in the selection of a currently enabled audio source for the headset.

Other aspects, the method can include storing metadata indicating presence of the headset within a particular soundscape environment, and enabling the causing of an audio sample to be played in response to the metadata indicating presence.

Also, once aspect of the technology herein is a headset configured for operating as discussed above.

Figure 3:
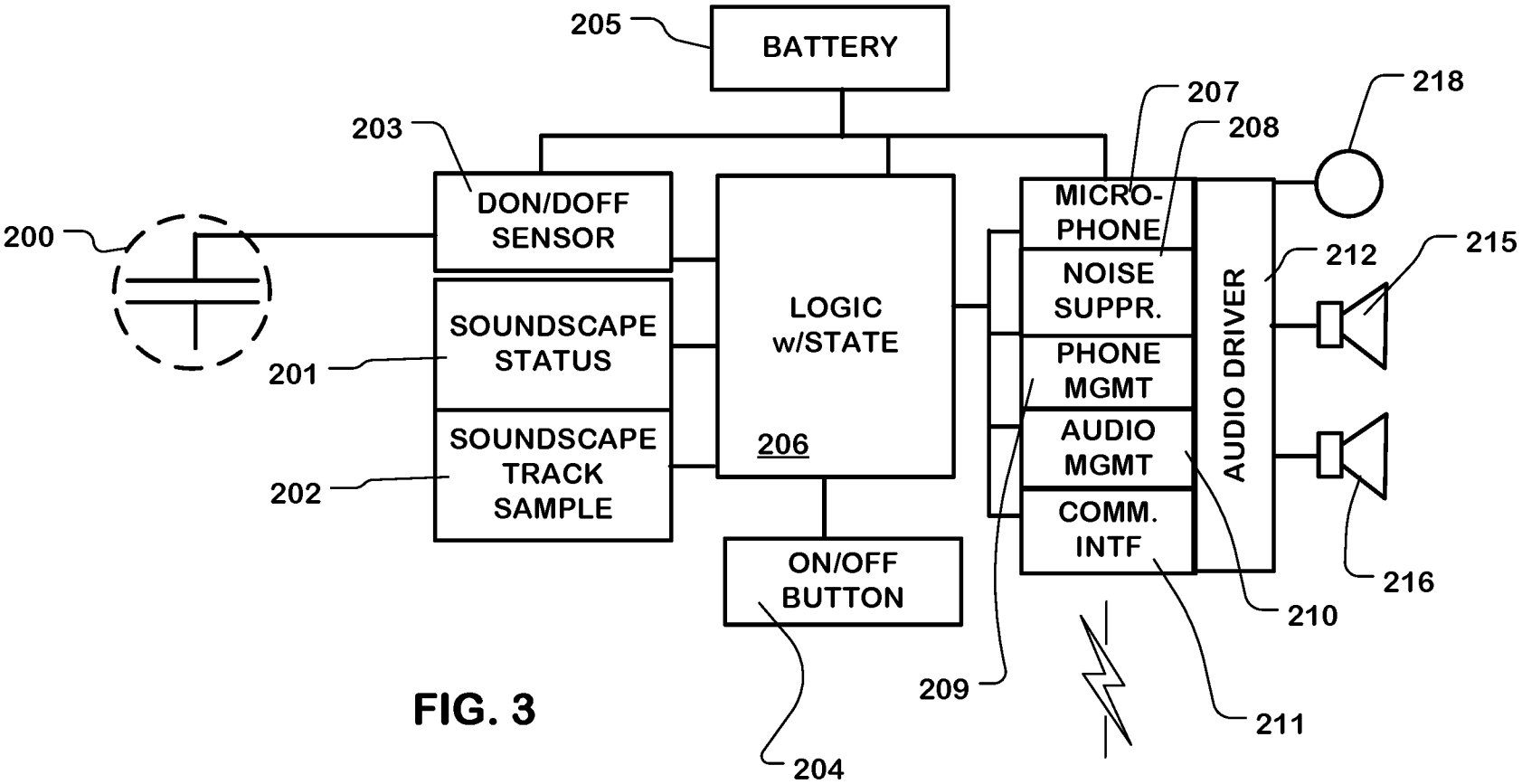
FIG. 3 is a simplified diagram of electronic components of the headset including logic for soundscape coordination.

FIG. 3 is a simplified diagram of electronic circuitry on an example of a headset including a Don/Doff sensor circuit 203 with a capacitive speaker capsule proximity sensor 200 in this example. The Don/Doff sensor circuit 203 can generate electrical signals to activate the capacitive sensor, and sense capacitance. In response to the sensed capacitance, a signal is generated, for example, if the capacitance meets a threshold condition indicating that the speaker capsule is close to a conductive surface such as a person's ear. Other types of Don/Doff sensors may be deployed as well, such as accelerometer based sensors.

Circuitry on the headset includes an on/off button 204 (or switch) and a battery 205. Also, the button 204 or another button not shown, can be used in place of the Don/Doff sensor, or in coordination with it, to control the playing of soundscape coordinated audio as described herein.

The electronic circuitry on the headset includes a speaker on each ear capsule, including speakers 215 and 216, in this example. Also, a microphone 218 may be included on the headset. An audio driver 212 is coupled to the speakers and controlled by functional logic and circuits on the device. In the illustrated example, functional logic and circuits on the headset include microphone management logic 207, noise suppression logic 208, telephone management logic 209, audio management logic 210, and a communication interface 211.

Logic circuitry 206, which can maintain a state that indicates a sequence of transitions in signal, is coupled to the Don/Doff sensor circuit 203 and other signal sources such as the button, and generates control signals in response to the signal generated by the Don/Doff sensor circuit 203. The control signals are based on interpretation of the signals, and are applied to the functional logic and circuits 207-211.

Power management logic not shown can be included and used to apply variant power conditions to components of the headset depending on an operating mode. The power management logic can change from an active operating mode to a power saving mode, in which the power applied to one or more of the components of the headset is reduced compared to the power applied during the previous active operating mode, or compared to the power applied during a subsequent operating mode. One example power saving mode might place the headset in an idle mode in which power to the audio driver 212 is off, while power to the communication interface 211 remains on, with a low communication speed for example. A variety of power saving modes might be implemented depending on the state of the headset when the power saving mode event occurs.

Microphone logic 207 and noise suppression logic 208 can operate in coordination to suppress noise in the environment in some embodiments. The noise suppression logic 208 can be disabled when an active soundscape is detected, and soundscape coordinated audio is being played at the headset. Alternatively, the noise suppression logic 208 can operate along with the soundscape coordinated audio.

The telephone management logic 209 can manage a communication protocol with a host device that includes a telephone. The communication protocol can include exchanging messages to cause auto answer of a telephone call, to cause hanging up of a telephone call, and to cause other functions related to handling of telephone calls.

The audio management logic 210 can manage a communication protocol with a host device that includes a source of audio streaming data, which can be played using the speakers on the headset. The communication protocol of the audio management logic can include exchanges of messages to cause a pause of an audio stream, a resume of an audio stream, and other functions related to handling of audio streams.

The communication interface 211 can include corded or wireless communication ports adapted for communication with a host device. The communication interface can have more than one operating mode, depending on the characteristics of the host device, the power management mode of the device, and other characteristics.

The logic 206, and the other circuitry modules 207-212, can be implemented using analog and digital circuitry. In some examples, logic is implemented using a processor executing computer instructions. In some examples, the logic is implemented using dedicated state machines and other logic circuitry. In some examples, the logic is implemented using a combination of a processor with dedicated circuitry.

The headset in this example includes memory 201 including storage for metadata which specifies one or more aspects of soundscape status, and memory 202 for one or more audio samples designed for coordination with one or more corresponding soundscape tracks.

The logic 206 in this example operates in coordination with a computer program or other types of logic running on a host device via the communication interface 211 to cause an audio sample of the one or more audio samples stored in the memory 202 to be played using a speaker or speakers on the headset. Thus, the logic 206 on the headset can be responsive to control signals from the host device.

The logic 206 in this example, includes a first mode which in response to a Don signal causes a transition in volume of the audio sample from an initial volume, which can be very low or zero, to a target volume that can be selected or coordinated with the audio track being played in the soundscape environment at a comfortable level. This first mode allows for transition to wearing a headset in the open office environment to occur with minimal discomfort for the individual, tending to maintain continuity of the soundscape.

The logic 206 can include a second mode in which the volume of the audio sample remains at a target level coordinated with the audio track being played in the soundscape environment. This level can fluctuate with changes in the level of the soundscape environment, or can be set at a level suited to the fact that the individual is wearing a headset and may not be subject to the same types of distracting noises that the soundscape environment operates to offset by varying the volume of the audio track.

The logic 206 can cause the audio sample to play repeatedly in a loop to provide the audio sequence played at the headset. In this manner, the audio sample can be compact, using a small amount of memory space, and require very limited communication resources and battery power to maintain the coordinated sound. The audio sample is coordinated with the audio track being played in the soundscape, so that the individual's perception of the soundscape when the headset is donned, is continuous or as non-distracting as practical. The audio sequence in some embodiments can be synchronized in time with the audio track, but such time synchronization may not be necessary for coordination with soundscape audio tracks in a way that is pleasing to individuals.

Logic 206, in coordination with the host device, can store metadata in the memory 201 that concerns or relates to the soundscape environment, including an identifier of the audio sample to be played at any given time, or to be played in the presence of any particular soundscape system. Also, the headset may include logic to detect or indicate a location of the headset as discussed above.

Also, the logic 206 in coordination with a host device, can communicate with the soundscape server or other source of audio tracks being played in the soundscape environment to retrieve metadata concerning the soundscape environment. In this embodiment, the logic can change the audio sample being played at the headset in response to a change indicated by the metadata in the audio track being played in the soundscape environment. In this manner, the individual wearing the headset can remain coordinated with the soundscape as the audio track is changed over time.

The logic causing the audio sample to be played on the headset in coordination with the soundscape can be operated in coordination with other functions of the headset and host device. For example, the telephone management logic 209 can comprise logic to communicate with a host device including a telephone. This logic can play audio signals from the host device in support of a telephone call. Also, this logic can cause playing of the audio sample used for coordination with the soundscape to pause and resume in response to messages from the host device related to an active call on the telephone.

In another example, audio management logic 210 can comprise logic to communicate with a host device that provides audio streaming. This logic can play audio signals from the host device in support of the audio streaming. Also, this logic can cause the playing of the audio sample used for coordination with the soundscape to pause and resume in response to messages from the host device related to activity of the streaming audio.

Also, in some embodiments, the metadata stored in the memory 201 can be updated from time to time to indicate presence of the headset within a particular soundscape environment. Logic 206 can select an audio sample corresponding to the particular soundscape environment, and enable the audio driver to play the particular audio sample in response to such indication. This metadata can be generated by the host device in communication with the soundscape server, and provide indication of presence in the particular soundscape environment. Also, the metadata indicating presence of the headset or host device in a particular soundscape environment can be generated using audio analysis of the environment of by other techniques that may not require communication with a soundscape server. With metadata indicating presence in a particular soundscape environment, the headset can be considered "location aware", and automatically play an audio sample that coordinates with the soundscape in which it is located.

Figure 4:
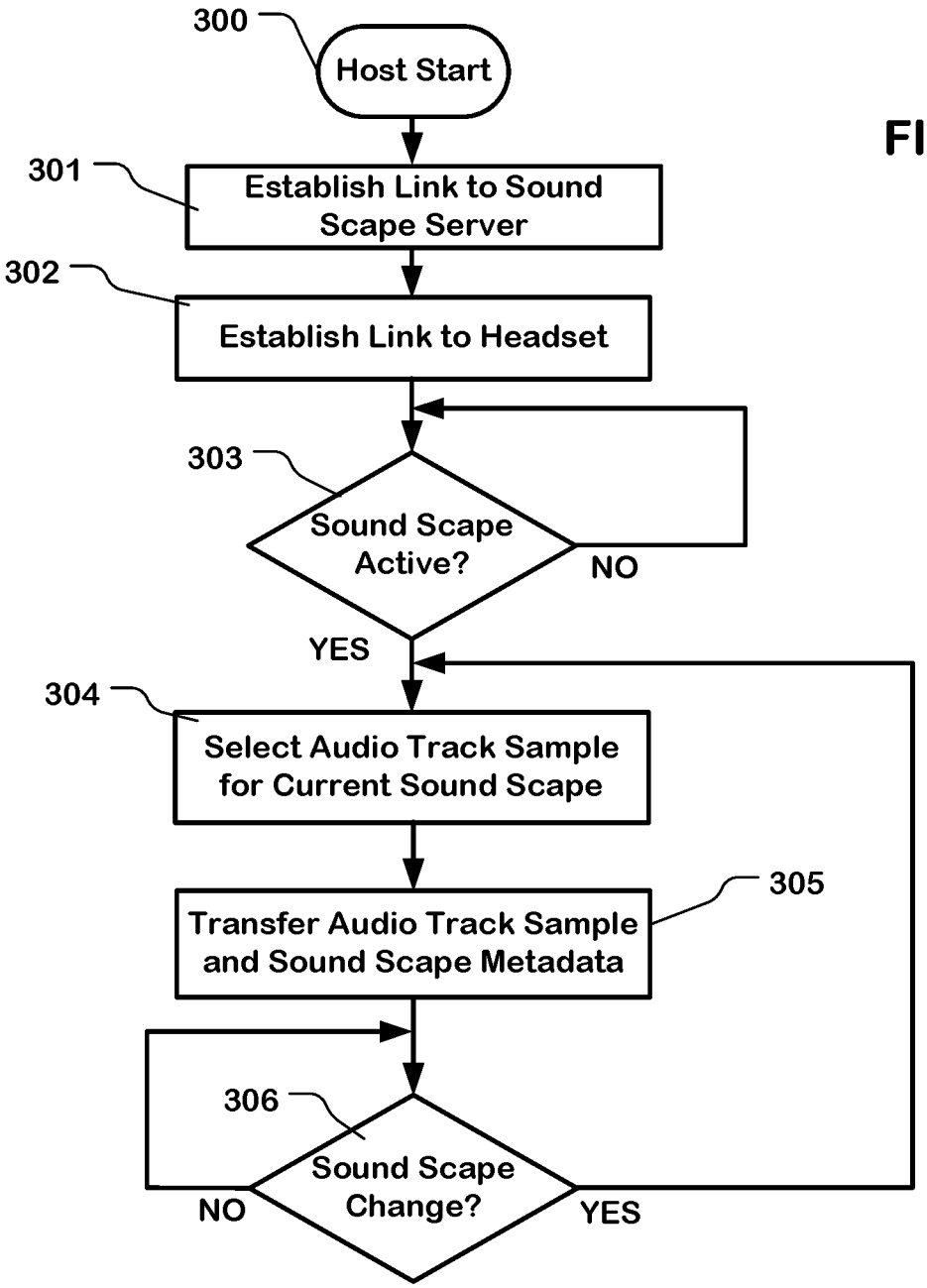
FIG. 4 is a simplified flowchart for operating a headset in coordination with a soundscape system.

FIG. 4 is a simplified flowchart of a logic used to set up a headset for coordinated operation with a soundscape. In this example, the logic is executed on a host. Thus the flowchart begins with a host startup (300). The host establishes a communication link to the soundscape server (301). Also, the host establishes a communication link to the headset (302). The host determines whether the soundscape server is maintaining an active soundscape at the location in which the host or the headset is disposed (303). If not, the host device can continue to monitor for an active soundscape. If an active soundscape is being executed, then the host can select an audio sequence, such as by selected a pre-stored audio track sample, for the current soundscape (304). The host can then transfer the audio track sample and soundscape metadata to the headset (305). Alternatively, the host can include logic to select and stream an audio sequence to the headset, the audio sequence being selected in response to the active soundscape. Also, the host can continue to monitor for changes in the soundscape by communication with the soundscape server (306). Upon detecting a change, the logic can return to blocks 304 and 305, where it selects an audio track sample for the current soundscape and transfers that audio track sample along with metadata to the headset.

Figure 5:
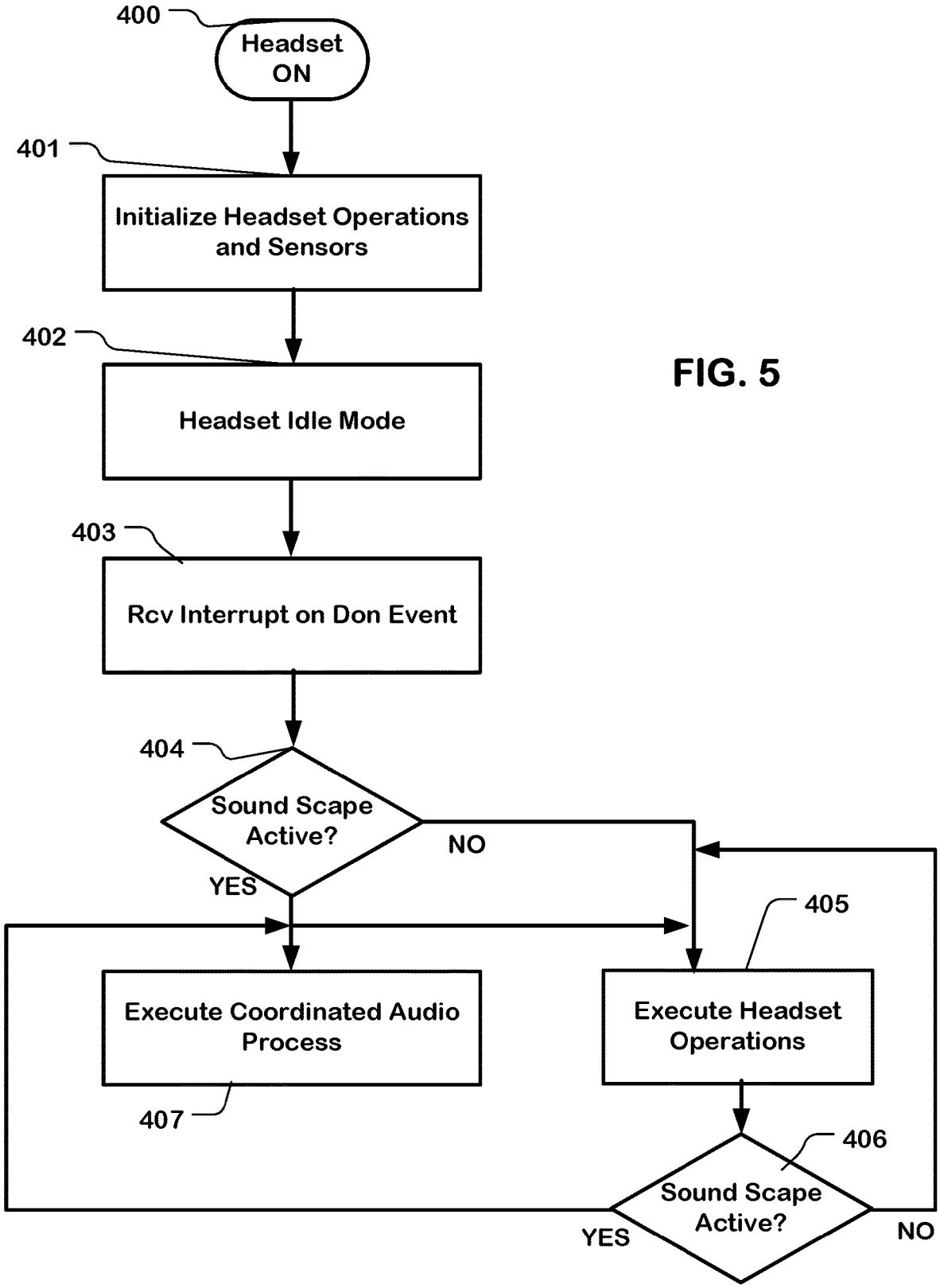
FIG. 5 is a simplified flowchart for control logic on a headset as described herein operable in coordination with a soundscape system.

FIG. 5 illustrates logic to cause an audio sample to be played in coordination with a soundscape executed by a program that can be executed using one or both of host programs and logic on the headset. In this example, the flowchart begins with a headset on event (400). Logic on the headset initializes headset operations and sensors when the headset is turned on (401). The headset logic enters the headset idle mode after it is turned on in some embodiments (402). When the individual puts the headset on, an interrupt is generated by the Don/Doff sensor and received by logic (403). Logic on the headset determines whether a soundscape is active by reading the metadata stored in its memory (404). If no soundscape is active, the headset proceeds with executing headset operations, such as playing streaming audio, participating in communication with a telephone, noise suppression and so on (405). While executing headset operations, the headset can continue to monitor communications with a host and metadata stored in memory to determine whether a soundscape has become active (406). If a soundscape is active at block 404, or at block 406, coordinated audio processes are executed, to coordinate with the soundscape by playing audio samples at the headset (407).

Figure 6:
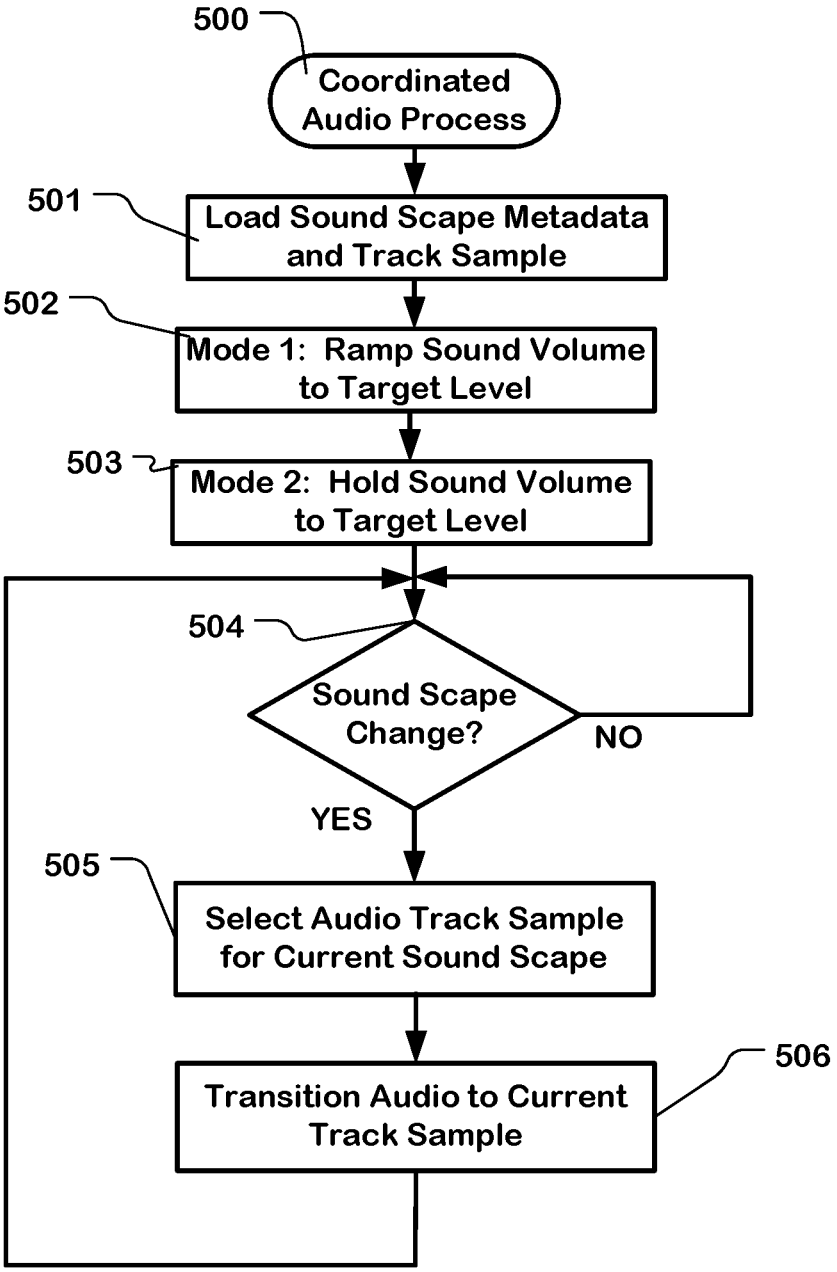
FIG. 6 is a simplified flowchart for logic to cause an audio sample to be played in coordination with a soundscape audio track.

FIG. 6 illustrates an example of a coordinated audio process that can be executed at block 407 in the logic of FIG. 5. The logic of FIG. 6 begins with initiation of a coordinated audio process (500). In this example, soundscape metadata and a track sample are loaded by the logic in preparation of playing the soundscape track sample (501). Then the first mode is entered, in which the sound volume of the track sample is ramped to a target level (502). After the track sample is ramped to a target level, a second mode is entered in which the target level is maintained at a level coordinated with the soundscape (503).

Logic on the headset, or in the host, monitors for a change in the soundscape audio track (504) while operating in the second mode (and optionally while operating in the first mode). If no change in the soundscape is detected, then the logic continues to monitor for a soundscape change. If a change in the soundscape is detected, then the logic can select an audio track sample 505 for the current soundscape, and enter a mode for transition of the audio to the current track sample (506). The transition of the audio to the current track sample can involve ramping down the volume of the track sample being played, and then ramping up the volume of the new current track sample or other procedures that can avoid jarring changes relative to the soundscaping in audio at the headset. After changing to the new current track sample, logic on the headset can continue to monitor for other soundscape changes.

Although not shown, if an interrupt is received indicating a Doff event while the headset is performing headset operations, then the circuitry can cause an action appropriate to the interrupted operation (e.g., pause audio stream, hang up telephone, stop soundscape coordinated audio, etc.), and return to the headset idle mode 303.

Portions of methods described herein can be implemented using computer programs stored on a computer-readable memory, including a non-transitory storage medium or media, storing instructions executable by a processor to perform any of the methods described above. Yet another implementation of the method described in this section can include a system including memory and one or more processors operable to execute instructions, stored in the memory, to perform any of the methods described above.

A number of flowcharts illustrating logic are described herein. The logic can be implemented using processors programmed using computer programs stored in memory accessible to the computer systems and executable by the processors, by dedicated logic hardware, including field programmable integrated circuits, and by combinations of dedicated logic hardware and computer programs.

With all flowcharts herein, it will be appreciated that many of the steps can be combined, performed in parallel, or performed in a different sequence without affecting the functions achieved. In some cases, as the reader will appreciate, a rearrangement of steps will achieve the same results only if certain other changes are made as well. In other cases, as the reader will appreciate, a rearrangement of steps will achieve the same results only if certain conditions are satisfied. Furthermore, it will be appreciated that the flow charts herein show only steps that are pertinent to an understanding of the invention, and it will be understood that numerous additional steps for accomplishing other functions can be performed before, after and between those shown.

Several elements to a solution of the problem of coordinating headset use with soundscapes are provided. When an individual may not be wearing the headset, and for conversations outside of a zone of intelligibility, the soundscape provides appropriate protection from distracting noises. However, if the individual decides that they can still understand speakers inside the zone of intelligibility who are speaking loudly, or if the individual is sensitive to the conversation, they can begin wearing their headset. Audio can be played at the headset that matches what the room soundscape system is playing very closely. The audio can be a biophilic sound that is both pleasing, non-fatiguing and is designed specifically to block distracting speech. The sound can be played as a loop via the headset, eliminating intelligible speech inside the zone of intelligibility. Also, a soundscaping system provides a customer the ability to change the biophilic sound from one sound to another. The system described herein provides for coordinating the sound between the room sound and the headset sound, as the room sound changes over time. Furthermore, the headset can be configured to automatically ramp the biophilic sound from a low dB level to the normal level to avoid a jarring sound to the user. This can take place when the headset is put on the head, when a call is dropped, or when another transition occurs. Furthermore, when a call is initiated or answered, the biophilic sound can be dropped to a low or zero level depending on system administration.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

What is claimed is:

1. An apparatus for use in a soundscape environment in which audio tracks are played, comprising:

a headset including a speaker and an audio driver coupled to the speaker; and logic in communication with the audio driver to access metadata related to a soundscape environment for the headset, to use the metadata to identify an audio track currently being played in the soundscape environment, and to cause the identified audio track to be played using the speaker on the headset.

2. The apparatus of claim 1, including a sensor on the headset which generates a Don signal when the headset is placed on a user's head, and the logic causes the indicated audio sequence to be played in response to the Don signal.

3. The apparatus of claim 1, including logic to determine location of the headset, and to use the location to identify the metadata associated with the soundscape environment.

4. The apparatus of claim 1, including memory on the headset storing one or more audio samples having audio content coordinated with one or more corresponding audio tracks of soundscape environment, and wherein the logic to identify the audio track selects an audio sample from the one or more audio samples in the memory for the track.

5. The apparatus of claim 1, wherein the headset includes logic to communicate with a host device, and the host device includes said logic to identify the audio track.

6. The apparatus of claim 1, wherein the headset includes logic to communicate with a host device, and to play audio signals received from the host device, and including logic to cause the playing of the identified audio track to pause and resume in response to messages from the host device.

7. The apparatus of claim 1, wherein the headset includes logic to communicate with a host device including a telephone, and to play audio signals received from the host device, and including logic to cause the playing of the identified audio track to pause and resume in response to messages from the host device related to an active call on the telephone.

8. The apparatus of claim 2, the logic in response to the Don signal to cause volume of the audio sequence to transition from an initial volume to a target volume.

9. An apparatus for use in a soundscape environment in which audio tracks are played, comprising:

a headset including a speaker and an audio driver coupled to the speaker; and logic to communicate with a server which controls audio tracks played in the soundscape environment to identify an audio track currently being played in the soundscape environment, to cause the identified audio track to be played using the speaker on the headset, and to change the audio track in response to a change indicated by the communications with the server.

10. The apparatus of claim 9, wherein the logic to communicate with the server communicates via a host device in communication with the server.

11. A method for operating a headset including a speaker and an audio driver coupled to the speaker in coordination with a soundscape environment; comprising:

identifying an audio track currently being played in a soundscape environment based on metadata related to a soundscape environment for the headset; and causing the identified audio track to be played using the speaker on the headset.

12. The method of claim 11, including generating a Don signal when the headset is placed on a user's head, and causing the identified audio track to be played in response to the Don signal.

13. The method of claim 11, including storing one or more audio samples having audio content coordinated with one or more corresponding audio tracks of a soundscape environment.

14. The method of claim 11, including logic to determine location of the headset, and to use the location to identify the soundscape environment.

15. The method of claim 11, including communicating with a server which controls the audio tracks played in the soundscape environment, and changing the audio track being played in the headset in response to a change indicated by the communications with the server.

16. The method of claim 11, communicating between the headset and a host device, the host device in communication with a server, the server controlling the audio tracks played in the soundscape environment, and including changing the audio track being played in the headset in response to a change in the audio tracks played in the soundscape environment indicated by communications from the host device.

17. The method of claim 11, including storing in memory one or more audio samples having audio content coordinated with one or more corresponding audio tracks of soundscape environment, and said identifying an audio track includes selecting an audio sample from the one or more audio samples in the memory for the audio sequence.

18. The method of claim 11, including communicating between the headset and a host device, and playing audio signals received from the host device, and causing the playing of the identified audio track to pause and resume in response to messages from the host device.

19. The method of claim 11, including communicating between the headset and a host device including a telephone, and causing the identified audio track to pause and resume in response to messages from the host device related to an active call on the telephone.

20. The method of claim 12, including causing in response to the Don signal volume of the audio track to transition from an initial volume to a target volume.

21. A headset for use in a soundscape environment in which audio tracks are played, comprising:

a speaker and an audio driver coupled to the speaker;

memory storing one or more audio samples having audio content coordinated with one or more corresponding audio tracks of the soundscape environment;

a sensor which generates a Don signal when the headset is placed on a user's head; and logic in communication with the audio driver to cause an audio sample of the one or more audio samples stored in the memory to be played using the speaker on the headset, including a first mode in response to the Don signal in which volume of the audio sample transitions from an initial volume to a volume coordinated with an audio track being played in the soundscape environment, and a second mode in which the volume of the audio sample remains coordinated with the audio track being played in the soundscape environment.

* * * * *